US006193903B1

(12) United States Patent
Gay et al.

(10) Patent No.: US 6,193,903 B1
(45) Date of Patent: Feb. 27, 2001

(54) METHOD OF FORMING HIGH-TEMPERATURE MAGNETIC ARTICLES AND ARTICLES FORMED THEREBY

(75) Inventors: David Earl Gay, Pendleton; David Allen Score, Shirley, both of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/311,714

(22) Filed: May 14, 1999

(51) Int. Cl.[7] ..... H01F 1/37; H01F 1/39

(52) U.S. Cl. ..... 252/62.55; 252/62.53; 252/62.54; 148/104; 148/105; 264/611; 264/612

(58) Field of Search ..... 252/62.55, 62.53, 252/62.54; 148/104, 105; 264/611, 612

(56) References Cited

U.S. PATENT DOCUMENTS

| | | | | |
|---|---|---|---|---|
| 4,177,089 | * | 12/1979 | Bankson | 148/104 |
| 4,919,734 | * | 4/1990 | Ochiai et al. | 148/306 |
| 5,116,437 | * | 5/1992 | Yamamoto et al. | 148/105 |
| 5,183,631 | * | 2/1993 | Kugimiya et al. | 419/10 |
| 5,982,073 | * | 11/1999 | Lashmore et al. | 310/254 |
| 6,051,324 | * | 4/2000 | Moorhead et al. | 428/552 |

* cited by examiner

*Primary Examiner*—C. Melissa Koslow
(74) *Attorney, Agent, or Firm*—Margaret A. Dobrowitsky

(57) ABSTRACT

Ceramic-coated powdered ferromagnetic materials for forming magnetic articles, and which maintain the mechanical and magnetic properties of the articles at high temperatures, such as during annealing to relieve stresses induced during the forming operation. The ceramic coatings are formed by one of several techniques to provide an encapsulating layer on each ferromagnetic particle. The particles are then compacted to form a solid magnetic article, which can be annealed without concern for degrading the ceramic coating.

31 Claims, No Drawings

METHOD OF FORMING HIGH-TEMPERATURE MAGNETIC ARTICLES AND ARTICLES FORMED THEREBY

TECHNICAL FIELD

The present invention generally relates to AC electromagnetic cores formed by powder metallurgy. More particularly, this invention relates to ferromagnetic particles coated with a ceramic layer that, when the particles are compression molded to form a net-shaped magnetic article, enables the article to be annealed at high temperatures to improve magnetic properties, including low frequency output.

BACKGROUND OF THE INVENTION

The use of powder metallurgy (P/M), and particularly iron and iron alloy powders, is known for forming magnets, including soft magnetic cores for transformers, inductors, AC and DC motors, generators, and relays. An advantage to using powdered metals is that forming operations, such as compression molding, injection molding and sintering techniques, can be used to form intricate molded part configurations, such as magnetic cores, without the need to perform additional machining and piercing operations. As a result, the formed part is often substantially ready for use immediately after the forming operation.

Molded magnetic cores for AC applications generally should have low magnetic core losses, which requires that the individual metal particles within the magnetic core be electrically insulated from each other to provide eddy current protection, while also achieving an acceptable level of permeability. Numerous types of insulating materials have been suggested by the prior art, many of which also serve as a binder that adheres the particles together. Examples of such materials include inorganic materials such as iron phosphate, alkali metal silicates, and organic polymeric materials. In addition to providing adequate insulation and adhesion between the metal particles upon molding, insulating materials are often selected for their ability to provide sufficient lubrication during the forming operation to enhance the flowability and compressibility of the particles, and therefore enable the particles to attain maximum density and strength, particularly when compression molded at high pressures.

In view of the above considerations, plastics have been widely used as insulating materials for AC magnetic cores. However, the permeability of magnetic articles formed with plastic insulating materials is not sufficiently high for many AC applications, and core losses are often high at low frequencies (e.g., 50 Hz and less), resulting in low outputs at low rpms. Increased permeability and lower hysteresis losses can be achieved by annealing the core to relieve the detrimental effects on magnetic characteristics caused by cold working during compression molding. However, relieving substantially all stresses in a work-hardened core formed of ferromagnetic materials often requires maintaining the core at a temperature of at least 600° C. for a length of time that depends on the degree of work hardening in the core, followed by slow cooling. Plastic materials currently available are unable to withstand these temperatures, and degrade and pyrolyze during annealing. The ability of the insulating material to encapsulate and adhere the particles will also degrade if the core is annealed at lower temperatures that exceed the heat deflection temperature of the insulating material. Even if physical destruction of the core does not occur, the magnetic field characteristics of the core will likely be severely impaired because of the degradation of the insulating capability of the material.

In view of the above, it can be appreciated that, because the insulating material must remain within an AC magnetic core to achieve low core losses, the ability to anneal a core is limited by the heat resistant properties of the insulating material. Maximum operating temperatures of AC magnetic cores are similarly limited by the insulating material. Therefore, it would be desirable to provide a coating for powdered metals that has the ability to withstand high processing and operating temperatures, so that P/M magnetic cores molded from such particles exhibit desirable mechanical and magnetic properties that do not deteriorate at high temperatures.

SUMMARY OF THE INVENTION

According to the present invention, methods are provided for producing and processing ceramic-coated powdered ferromagnetic materials, particularly iron and its alloys, which when used to form a magnetic article, maintain the mechanical and magnetic properties of the article at high temperatures, such as during annealing of the article to relieve stresses induced during the forming operation.

The ceramic coating materials of this invention can generally be metal oxides, nitrides, carbides, ferrites, silicates and phosphates, and are present as an encapsulating layer on each ferromagnetic particle. The particles are then compacted using any suitable technique to form a solid magnetic article, which can then be fully annealed without concern for degrading the ceramic encapsulating layer. Thereafter, the magnetic article is ready for use, though in some circumstances it may be desirable to impregnate the article with a polymeric material to increase the strength and corrosion resistance of the article.

The invention encompasses several techniques for forming the ceramic encapsulating layer. According to one embodiment, the ferromagnetic particles are oxidized. For example, iron-based ferromagnetic particles are oxidized under controlled conditions to yield an encapsulating layer that consists essentially of iron oxides. In another embodiment, the ceramic material is applied in powder form, and preferably combined with a polymeric material such that the encapsulating layer initially comprises a mixture of the polymeric and ceramic material. Annealing is then performed under conditions that decompose the polymeric material and cause the ceramic material to flow and encapsulate the ferromagnetic particles. In yet another embodiment, the encapsulating layer is formed by applying a coating of an organometallic compound to the ferromagnetic particles, and then heating the particles to convert the organometallic compound to a ceramic material. With each of these embodiments, the encapsulating layer can be overcoated with a polymeric coating that serves as a lubricant during forming of the article, and is then decomposed during annealing.

In view of the above, it can be appreciated that this invention provides a magnetic article formed of compacted and annealed ferromagnetic particles, with each particle being encapsulated with an insulating layer of ceramic material. With the ceramic insulating layer, the particles and an article formed from the particles can be fully annealed and exposed to high temperatures without degrading the insulating effect of the insulating layer, such that the mechanical and magnetic properties of the article do not deteriorate. Ceramic insulating layers of this invention have also been shown to produce articles having significantly higher permeability and lower hysteresis losses as compared to those with polymer insulating layers, while maintaining the strength, density and eddy current protection necessary for demanding AC applications, particularly at lower frequencies, e.g., 50 Hz and less.

Other objects and advantages of this invention will be better appreciated from the following detailed description.

DESCRIPTION OF THE PREFERRED EMBODIMENT

The invention will be described in terms of coating materials and processes for powdered metal materials, and particularly ferromagnetic materials that are molded under pressure to form magnetic articles, such as AC magnetic cores used in the automotive industry. However, the teachings of this invention can also be applied to the molding of other types of articles.

According to the present invention, ferromagnetic particles are provided with a ceramic encapsulating layer that provides electrical insulation between the particles when coalesced to form a magnetic article. Ferromagnetic particulate materials that can be used with this invention include iron, nickel and cobalt alloys, iron-silicon alloys, iron-phosphorus alloys, Fe—Si—Al alloys such as Sendust alloys (nominally Fe-5.6Al-9.7Si), and magnetic stainless steels. A suitable average particle size range is about 5 micrometers to about 1000 micrometers, with a preferred average size being about 100 to 200 micrometers. The ceramic material is preferably present on the particles as a substantially uniform encapsulating layer that constitutes about 0.001% to about 2% weight percent of each particle. As will be described in greater detail below, the encapsulating layer consists entirely of the ceramic material, but may initially include a polymeric material that, during subsequent heating of the particles (e.g., annealing), degrades to leave a ceramic material as the sole constituent of the encapsulating layer within the magnetic article formed from the particles.

The ceramic encapsulating material provides electrical insulation between the particles, thereby reducing core losses in the magnetic article. More particularly, the ceramic encapsulating material provides stable mechanical properties and dielectric characteristics over a temperature range which exceeds the temperatures necessary to fully anneal the ferromagnetic particles after compaction. Consequently, a magnetic core formed from ferromagnetic particles coated with a ceramic material in accordance with this invention will not suffer significant degradation of the adhesive strength between the metal particles or experience detrimental flow of the coating that would degrade the insulating properties of the coating when exposed to elevated temperatures.

In a first embodiment of the invention, a ceramic encapsulating layer is formed by depositing the ceramic material directly on the ferromagnetic particles, such as by slurry coating, mechanical blending, vapor deposition or chemical reaction. In this embodiment, a preferred technique is to apply the ceramic material in powder form using a slurry coating technique. A suitable slurry composition contains about 5.0% weight percent ceramic powder, with the balance being an organic solvent such as acetone, methylene chloride, methanol, etc. Suitable ceramic materials include silicates (sodium silicate, potassium silicate, silica, etc.), metal oxides (alumina, zirconia, steatite, calcia, beryllia, etc.), nitrides (silicon nitride, boron nitride, titanium nitride, etc.), carbides (silicon carbide, boron carbide, zirconium carbide, titanium carbide), ferrites ($NaFeO_2$, $MgFe_2O_4$, $K_3FeO_6$, $SrFe_{12}O_{,19}$), and phosphates (FeP, $Fe_2P$, $Fe_3P$), with preferred ceramics being relatively low temperature materials such as silicates and silicon-base compounds. Ceramic particle size must be limited to appropriately coat the ferromagnetic particles. Acceptable particle sizes for the ceramic material are on the order of at least one-half to one order of magnitude smaller than the ferromagnetic particles. A generally suitable size range for the ceramic particles is about one to fifty micrometers, with a preferred particle size being about five to fifteen micrometers. The slurry is then applied to the ferromagnetic particles so that the ceramic material constitutes about 0.05% to about 2% weight percent of the ferromagnetic particles, more preferably about 0.1% to about 0.5% weight percent.

An optional constituent of the slurry is a polymer that will promote adhesion of the ceramic powder particles to each other and to the ferromagnetic particles. The inclusion of a polymer in the encapsulating layer also promotes the lubricity of the coated particles, so that magnetic articles can be produced from the coated particles with higher densities and green strengths. To be acceptable for the process and magnetic articles of this invention, the polymer must be capable of cleanly burning out during subsequent processing of the article. For this reason, preferred polymers include polyphenylene oxide (PPO) and poly (alkylene) carbonate. The polymer is dissolved in a solvent such as acetone or toluene, and then combined with the ceramic slurry in amounts sufficient to achieve a polymer content on the ferromagnetic particles of about 0.05 to about 2 weight percent, more preferably about 0.1 to 0.5 weight percent. Lower polymer contents result in inadequate green strength and poor moldability, while higher amounts are difficult to adequately burn out, yielding poorer magnetic properties and reduced strength. Another optional constituent of the ceramic slurry is a lubricant, such as stearates, fluorocarbons, waxes, low-melting polymers and synthetic waxes such as ACRAWAX available from Lonza, Inc.

If the ceramic slurry contains the polymer and/or lubricant, the particles are first dried to remove the solvent, leaving an encapsulating layer of ceramic particles within a polymer matrix. An optional overcoat of polymer and/or lubricant may then be applied over the encapsulating layer to further promote packing density, green strength and moldability. The overcoat layer is a particularly desirable addition if the ceramic encapsulating layer does not contain a polymer constituent. Suitable polymers and lubricants for the overcoat layer can be the same as those noted above for the polymer/lubricant constituent of the encapsulating layer. If used, the overcoat layer is present in amounts of about 0.1 to about 1 weight percent of the ferromagnetic particles, more preferably about 0.05 to 0.5 weight percent. Suitable methods for depositing the optional overcoat layer include known solution blending, wet blending and mechanical mixing techniques, and the use of a Wurster-type batch coating apparatus, such as those described in U.S. Pat. Nos. 2,648,609 and 3,253,944.

Once coated, the ferromagnetic particles are compacted to form the desired magnetic article by such known methods as uniaxial compaction, isostatic compaction, dynamic magnetic compaction, extruding and metal injection molding. Each of these techniques work-hardens the particles to some degree, reducing desirable magnetic properties such as permeability and increases hysteresis loses. Accordingly, the article is then annealed by heating to an appropriate temperature for the ferromagnetic material, followed by slow cooling. During annealing, any polymer and/or lubricant on the ferromagnetic particles is volatilized. Alternatively, the polymer and/or lubricant can be removed by heating the article to an intermediate temperature, generally in the range of about 800° F. to about 1200° F. (about 425° C. to about 650° C.), prior to annealing. If the ferromagnetic particles are formed of an iron, nickel, cobalt, iron-silicon, iron-phosphorus, or Fe—Si—Al alloy, annealing can typically be performed within a temperature range of about 900° F. to about 1800° F. (about 480° C. to about 980° C.). A preferred annealing treatment is carried out at about 1300° F. to about 1400° F. (about 700° C. to about 760° C.), for about 30 to 60 minutes, depending on the mass of the article. This treatment is sufficient to liquid phase sinter the ceramic particles, by which the ceramic particles melt and flow between and around the ferromagnetic particles to promote intraparticle insulation and strength.

After annealing, the article can be used as-is or further compacted, machined, and/or vacuum impregnated with a reactive liquid polymer (e.g., an epoxy) that can then be cured to increase the corrosion resistance and strength of the article. The impregnated polymer may constitute about 0.001 to about 0.2 weight percent of the total mass of the article.

In a second embodiment of the invention, the ceramic encapsulating layer is formed by a controlled reaction of the ferromagnetic particles to produce a layer of one or more oxide compounds. For example, iron-based particles are oxidized to form an encapsulating layer of iron oxides, typically FeO, $FeO_3$, $Fe_3O_4$, or a combination thereof. Iron oxide encapsulating layers can be formed by oxidizing iron-based particles at a temperature of about 300° F. to about 600° F. (about 150° C. to about 315° C.) in air, though it is foreseeable that oxidation could be performed in a controlled environment with a suitable humidity level. Other suitable methods for producing the oxide encapsulating layer are by substitution (chemical exchange) reaction or partial reduction (anodic reaction). The reaction process preferably proceeds for a duration sufficient to yield an oxide content on the particles of about 0.001 to about 1 weight percent, preferably about 0.05 to about 0.2 weight percent.

As with the first embodiment of the invention, the ferromagnetic particles can be overcoated with a polymer or lubricant using the same techniques and parameters described before. Thereafter, the particles are compacted to form the desired article, optionally heated to an intermediate temperature if any overcoat polymer or lubricant was used, but then otherwise annealed, all of which can be performed in accordance with the first embodiment.

In a third embodiment of the invention, the ceramic encapsulating layer is formed by first depositing a layer of an organometallic compound on the ferromagnetic particles, after which the organometallic compound is reacted to form a metal oxide encapsulating layer. A preferred organometallic compound is magnesium methylate, which is soluble in alcohol and can be applied to the ferromagnetic particles using a Wurster-type batch coating apparatus, such as those described in U.S. Pat. Nos. 2,648,609 and 3,253,944. Magnesium methylate can be reacted to form magnesia (magnesium oxide) by heating in air to a temperature of about 500° F. to about 700° F. (about 260° C. to about 316° C.), preferably about 600° F. (about 370° C.). Magnesium methylate is preferably applied on the ferromagnetic particles in an amount of about 0.05% to about 0.20% weight percent of the total mass of the particles, yielding a magnesia content on the particles of about 0.025% to about 0.10% weight percent. It is possible that greater magnesia contents could be used, though flaking and lower density are potential negative effects. As with the first and second embodiments of the invention, the ferromagnetic particles can subsequently be overcoated with a polymer or lubricant using the techniques and parameters noted above, and then compacted and annealed as before.

While the invention has been described in terms of a preferred embodiment, it is apparent that other forms could be adopted by one skilled in the art. For example, other polymer materials could be substituted for those noted, and a variety of powdered magnetic or magnetizable materials could be used. Accordingly, the scope of the invention is to be limited only by the following claims.

What is claimed is:

1. A method for molding a magnetic article, the method comprising the steps of:

forming on each of a plurality of ferromagnetic particles an encapsulating layer of a ceramic material by combining a polymeric material with a powder of the ceramic material such that the encapsulating layer comprises the polymeric material and the ceramic material;

compacting the ferromagnetic particles to form a solid magnetic article; and annealing the magnetic article so as to decompose the polymeric material.

2. A method as recited in claim 1, wherein the ceramic material is chosen from the group consisting of silicates, metal oxides, nitrides, carbides, ferrites and phosphates.

3. A method as recited in claim 2, wherein the ceramic material constitutes about 0.05 to about 2 weight percent of the total mass of the ferromagnetic particles.

4. A method as recited in claim 2, wherein the ceramic material used in the forming step is a powder of ceramic particles dispersed in a slurry, the ceramic particles ranging in size from about 1 to about 50 micrometers.

5. A method as recited in claim 1, wherein the polymeric material constitutes about 0.05 to about 2 weight percent of the total mass of the ferromagnetic particles immediately after the forming step.

6. A method as recited in claim 1, wherein the annealing step causes the powder of the ceramic material to become liquid phase sintered, by which the powder melts and flows between and around the ferromagnetic particles to promote intraparticle insulation and strength.

7. A method as recited in claim 1, further comprising the step of overcoating the encapsulating layer of the ferromagnetic particles with a polymeric coating after the forming step, wherein the polymeric coating is decomposed during the annealing step.

8. A method as recited in claim 7, wherein the polymeric coating constitutes about 0.1 to about 1 weight percent of the total mass of the magnetic article immediately after the overcoating step.

9. A method as recited in claim 1, wherein the ferromagnetic particles range in size from about 100 to about 200 micrometers.

10. A method as recited in claim 1, wherein the annealing step is performed at a temperature of about 480° C. to about 980° C. and causes the ceramic layer to be liquid phase sintered, by which ceramic particles of the ceramic layer melt and flow between and around the ferromagnetic particles to promote intraparticle insulation and strength.

11. A method as recited in claim 1, wherein the magnetic article is an AC magnetic core.

12. A method for molding a magnetic article, the method comprising the steps of:

forming on each of a plurality of ferromagnetic particles an encapsulating layer of a ceramic material;

compacting the ferromagnetic particles to form a solid magnetic article;

annealing the magnetic article; and then impregnating the magnetic article with a polymeric material.

13. A method as recited in claim 12, wherein the forming step entails oxidizing the ferromagnetic particles such that the ceramic material consists essentially of iron oxides.

14. A method as recited in claim 13, wherein the ceramic material constitutes about 0.001 to about 1 weight percent of the total mass of ferromagnetic particles.

15. A method as recited in claim 12, wherein the polymeric material constitutes about 0.001 to about 0.2 weight percent of the total mass of the magnetic article after the impregnating step.

16. A method as recited in claim 12, wherein the forming step entails applying a coating of an organometallic compound on the ferromagnetic particles, and then heating the ferromagnetic particles to convert the organometallic compound to the ceramic material.

17. A method as recited in claim 16, wherein the organometallic compound is magnesium methylate, and the ceramic material is magnesia.

18. A method as recited in claim 16, wherein the organometallic compound constitutes about 0.05% to about 0.20% weight percent of the total mass of the ferromagnetic particles immediately after the forming step.

19. A method as recited in claim 16, wherein the ceramic material constitutes about 0.025% to about 0.1% weight percent of the total mass of the ferromagnetic particles after the heating step.

20. A magnetic article comprising compacted and annealed ferromagnetic particles, each of the ferromagnetic particles being encapsulated with a layer of a ceramic material comprised of liquid phase sintered ceramic particles, wherein the ceramic particles were melted and flowed between and around the ferromagnetic particles to promote intraparticle insulation and strength, the magnetic article being impregnated with a polymeric material.

21. A magnetic article as recited in claim 20, wherein the ceramic material consists essentially of iron oxides formed in situ on the ferromagnetic.

22. A magnetic article as recited in claim 21, wherein the ceramic material constitutes about 0.001 to about 1 weight percent of the total mass of the ferromagnetic particles.

23. A magnetic article as recited in claim 20, wherein the ceramic material is chosen from the group consisting of silicates, metal oxides, nitrides, carbides, ferrites and phosphates.

24. A magnetic article as recited in claim 23, wherein the ceramic material comprises ceramic particles ranging in size from about 1 to about 50 micrometers.

25. A magnetic article as recited in claim 23, wherein the ceramic material constitutes about 0.05 to about 2 weight percent of the total mass of the ferromagnetic particles.

26. A magnetic article as recited in claim 20, wherein the polymeric material constitutes about 0.001 to about 0.2 weight percent of the total mass of the magnetic article.

27. A magnetic article as recited in claim 20, wherein the ceramic material is magnesia.

28. A magnetic article as recited in claim 27, wherein the ceramic material constitutes about 0.025 to about 0.1 weight percent of the total mass of the ferromagnetic particles.

29. A magnetic article as recited in claim 20, wherein the ferromagnetic particles range in size from about 100 to about 200 micrometers.

30. A magnetic article as recited in claim 20, wherein the magnetic article is an AC magnetic core.

31. A method for molding a magnetic article, the method comprising the steps of:

forming on each of a plurality of ferromagnetic particles an encapsulating layer of magnesia by applying a coating of magnesium methylate on the ferromagnetic particles and then heating the ferromagnetic particles to convert the magnesium methylate to magnesia, wherein at least one of the following conditions exists: the coating of magnesium methylate constitutes about 0.05% to about 0.20% weight percent of the total mass of the ferromagnetic particles immediately after the forming step; and the encapsulating layer of magnesia constitutes about 0.025% to about 0.1% weight percent of the total mass of the ferromagnetic particles after the heating step;

compacting the ferromagnetic particles to form a solid magnetic article; and then annealing the magnetic article.

* * * * *